US006932661B1

(12) United States Patent
Dai et al.

(10) Patent No.: US 6,932,661 B1
(45) Date of Patent: Aug. 23, 2005

(54) STEERING AND DIRECTIONAL REVERSING CONTROL FOR WATERJET PROPULSION

(75) Inventors: Charles M. Dai, Potomac, MD (US); Carl W. Baumann, Chantilly, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/863,845

(22) Filed: Jun. 3, 2004

(51) Int. Cl.[7] ..... B63H 11/107

(52) U.S. Cl. ..... 440/40; 440/43

(58) Field of Search ..... 440/40, 42, 43

(56) References Cited

U.S. PATENT DOCUMENTS 3,127,741 A * 4/1964 Pottharst, Jr. ..... 60/222
5,591,057 A 1/1997 Dai et al.

* cited by examiner

*Primary Examiner*—Jesus D. Sotelo
(74) *Attorney, Agent, or Firm*—Jacob Shuster

(57) ABSTRACT

Waterjet flow emerging from a jet propulsor body through a cross-sectionally circular duct is conducted through a cross-sectionally rectangular duct passage extending through transition and exhaust aft sections attached to and angularly adjusted relative thereto. Under selective maneuver controls within the propulsor body, the transition section is angularly adjusted relative to the body while pivotal vanes and flaps on the exhaust section are angularly adjusted to direct exit outflow through the exhaust section for steering and reversing purposes.

7 Claims, 4 Drawing Sheets

STEERING AND DIRECTIONAL REVERSING CONTROL FOR WATERJET PROPULSION

STATEMENT OF GOVERNMENT INTEREST

The invention described herein may be manufactured and used by or for the Government of the United States of America for governmental purposes without the payment of any royalties thereon or therefore.

The present invention relates generally to hull integrated waterjet propulsion having directional steering and reversing facilities.

BACKGROUND OF THE INVENTION

Waterjet propulsion devices for submersible vehicle hulls do not have directly associated therewith controls for steering and reversing propulsion thereof because of certain drag and damage problems imposed by existing jet propulsion steering and reversing control facilities that are available for surface vessels. It is therefore an important object of the present invention to provide a waterjet propulsion system applicable to underwater vehicles having steering and reversing facilities without imposition of drag and damage problems.

SUMMARY OF THE INVENTION

Pursuant to the present invention propulsion jet flow is directed axially through a cross-sectionally circular nozzle duct within an underwater sea vehicle into a cross-sectionally rectangular exhaust duct for vane controlled deflection during exit outflow therefrom. Also provided on the exhaust duct are angularly controlled flaps through which jet stream flow is selectively diverted rearwardly to exit directly from the exhaust duct, while electrically motorized means for rotation of the exhaust duct about the axis of the nozzle duct is also provided to angularly adjust such rearwardly diverted exiting of the jet stream flow.

BRIEF DESCRIPTION OF THE DRAWING

A more complete appreciation of the invention and many of its attendant advantages will be readily appreciated as the same becomes better understood by reference to the following detailed description when considered in connection with the accompanying drawing wherein.

DETAILED DESCRIPTION OF THE PREFERRED EMBODIMENT

Figure 1:
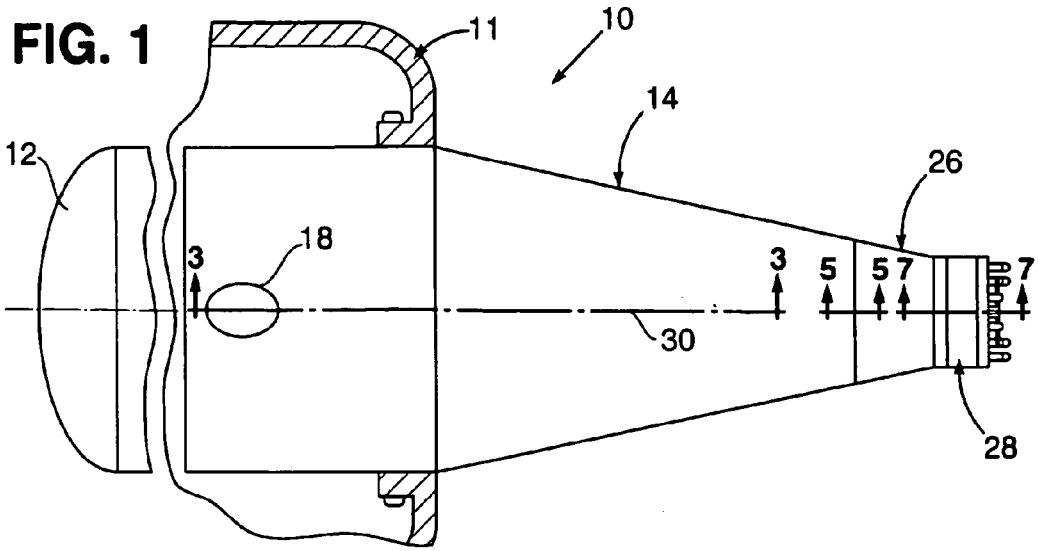
FIG. 1 is a partial top plan view of an axially elongated jet propulsion body projecting from an underwater sea vessel, in accordance with one embodiment of the present invention.
Figure 2:
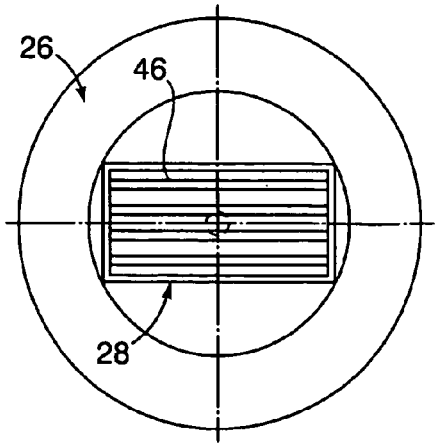
FIG. 2 is an aft end view of the propulsion body illustrated in FIG. 1.
Figure 3:
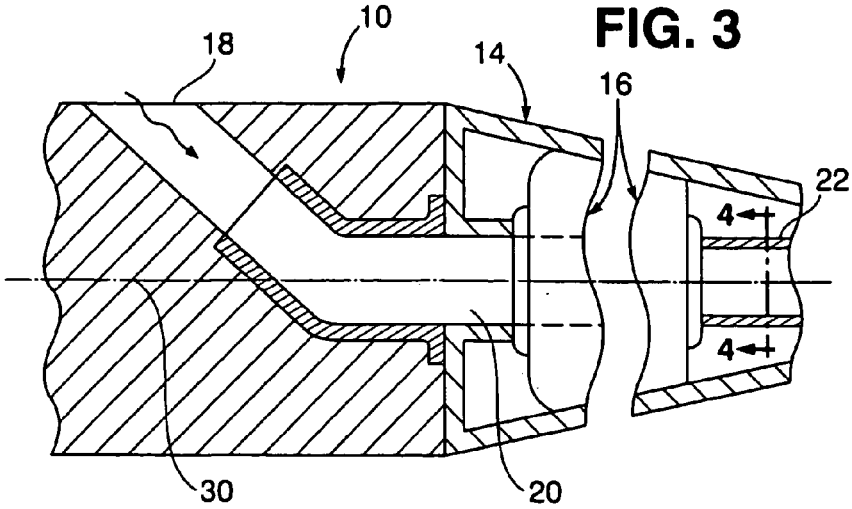
FIG. 3 is a section view taken substantially through a plane indicated by section line 3—3 in FIG. 1.
Figure 4:
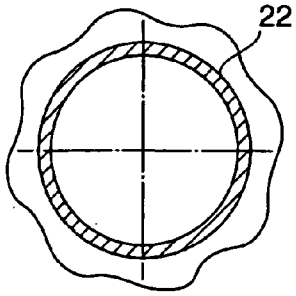
FIG. 4 is a transverse section view taken substantially through a plane indicated by section line 4—4 in FIG. 3.
Figure 5:
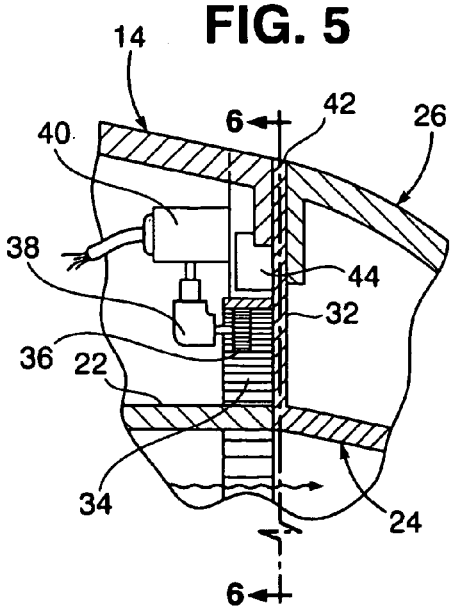
FIG. 5 is a partial section view taken substantially through a plane indicated by section line 5—5 in FIG. 1.
Figure 6:
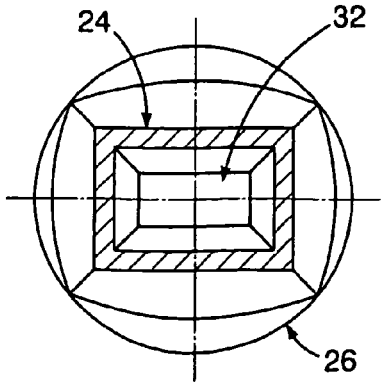
FIG. 6 is a transverse section view taken substantially through a plane indicated by section line 6—6 in FIG. 5.

Referring now to the drawing in detail, FIG. 1 illustrates an axially elongated and generally cylindrical revolution body 10 adapted to be mounted in a hull 11 of an underwater sea vessel vehicle for propulsion thereof. The body 10 has a closed forward end portion 12 from which it extends toward a converging aft end section 14 projecting from the sea vessel hull 11 for exposure to the seawater. Enclosed within the end section 14 of the body 10 is a jet propulsor 16 as shown in FIG. 3. The jet propulsor 16 is of a generally well known type into which an inflow of water from an inlet opening 18 is conducted through a cross-sectionally circular inlet conduit 20 axially aligned with a cross-sectionally circular outflow nozzle conduit 22 as shown in FIG. 4. Jet propelling outflow through the nozzle conduit 22 is directed into a cross-sectionally rectangular transition duct 24 within a rotatable convergent section 26 extending rearwardly from the aft end section 14 as shown in FIGS. 1, 5 and 6. Waterjet outflow from the transition duct 24 is conducted into a cross-sectionally rectangular exhaust duct section 28 fastened to the duct 24 as shown in FIGS. 1, 2 and 7, from which the waterjet outflow exits to impart propulsion force through the body 10 to the seawater vessel hull 11 along an axis 30 of the body 10.

As denoted in FIG. 5, the transition duct 24 has a radially extending flange 32 mounting an internal spur gear 34 within the aft end section 14 for meshing engagement with a pinion gear 36 driven through a right angle gear box 38 by an electric motor 40 positioned within the end section 14. Thus, under control of the motor 40 the transition duct section 26 may be angularly adjusted relative to the end section 14 of the body 10 by rotation relative thereto about the axis 30. An annular low friction seal plate 42 is shown positioned between the transition duct flange 32 and the body duct section 14 to maintain sealage within the body end sections 14 and 26 during rotational adjustment under steering operation as hereinafter explained. Support for the rotational end section 26 during such steering rotation thereof is provided for by an annular bearing assembly 44 on the aft section 14 at the seal plate 42 as shown in FIG. 5.

Figure 2A:
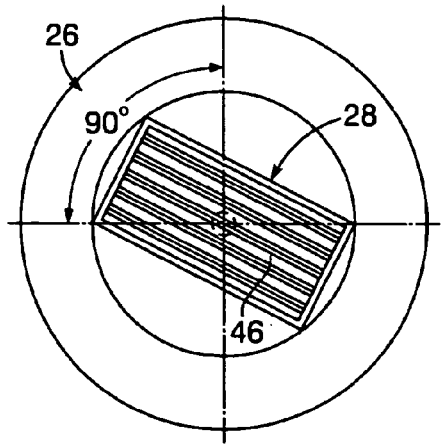
FIG. 2A is an end aft view corresponding to that of FIG. 2, showing the angularly adjusted steering condition for the jet propulsion body.
Figure 7:
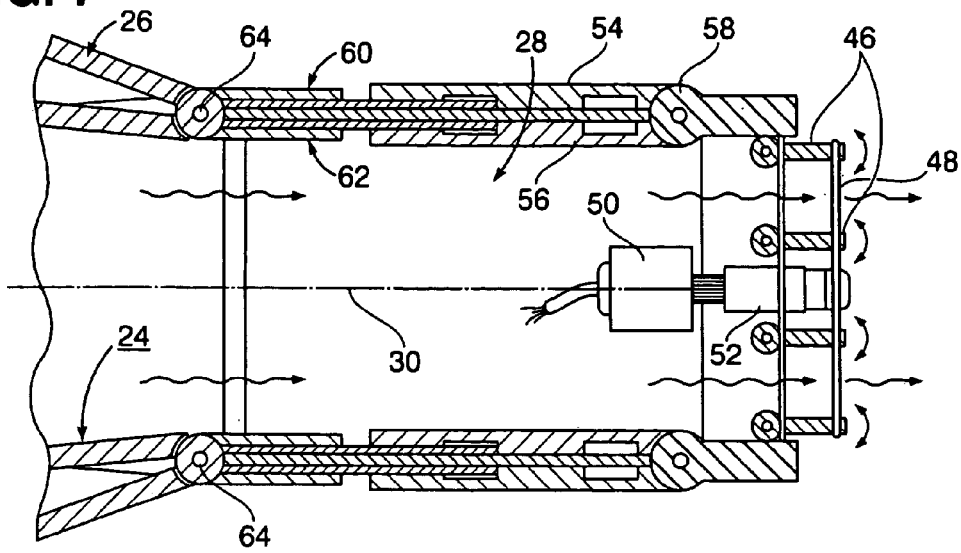
FIG. 7 is a section view taken substantially through a plane indicated by section line 7—7 in FIG. 1.
Figure 7A:
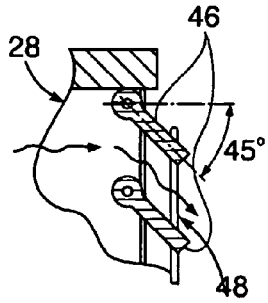
FIGS. 7A and 7B are partial section views corresponding to that of FIG. 7 showing certain steering and flow reversing adjustments.

As shown in FIGS. 7 and 7A, exit outflow of jet streams from the exhaust duct 28 is directionally controlled by deflection vanes 46 pivotally mounted inside of the exhaust duct 28 at its exit end. All of the vanes 46 are interconnected by linkage 48 so as to be rotated together in phase for steering purposes by an electric drive motor 50 through a rotary to linear motion converter type actuator 52, to which the linkage 48 is connected. Such in-phase angular positioning of the vanes 46 within 45° and rotational adjustment of the exhaust duct 28 by rotation of the body end section 26 connected thereto from the neutral position of the exhaust duct 28 as shown in FIG. 2 to angularly adjusted positions within 90° as shown in FIG. 2A will correspondingly effect a change in directional propulsion steering.

Figure 7B:
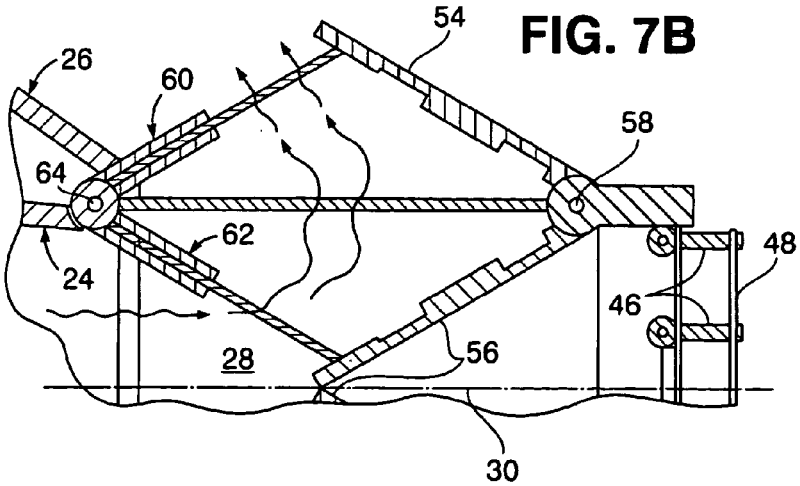

Referring now to FIGS. 7 and 7B, the exhaust duct 28 rotatable with the transition end section 26 about the axis 30, is formed by an assembly of an outer butterfly flap 54 and an inner butterfly flap 56. Both the outer and inner flaps 54 and 56 are angularly displaced about a pivot 58 from positions in contact with each other as shown in FIG. 7 respectively aligned with linear actuators 60 and 62 in their retracted conditions mounted by a pivot 64 at the aft end of the transition duct 24. In such positions of the flaps 54 and 56 aligned with the linear actuators 60 and 62 as shown in FIG. 7, jet stream flow is confined to the exhaust duct 28 for outflow from its exit end under directional control as aforementioned. When the flaps 54 and 56 are pivotally displaced by the linear actuators 60 and 62 to the positions shown in FIG. 7B, exit of the jet stream flow along the axis 30 from the exit end of the exhaust duct 28 is blocked by the inner flaps 56. Jet stream outflow is then reversed and directed backwardly by the outer flaps 54.

Figure 8:
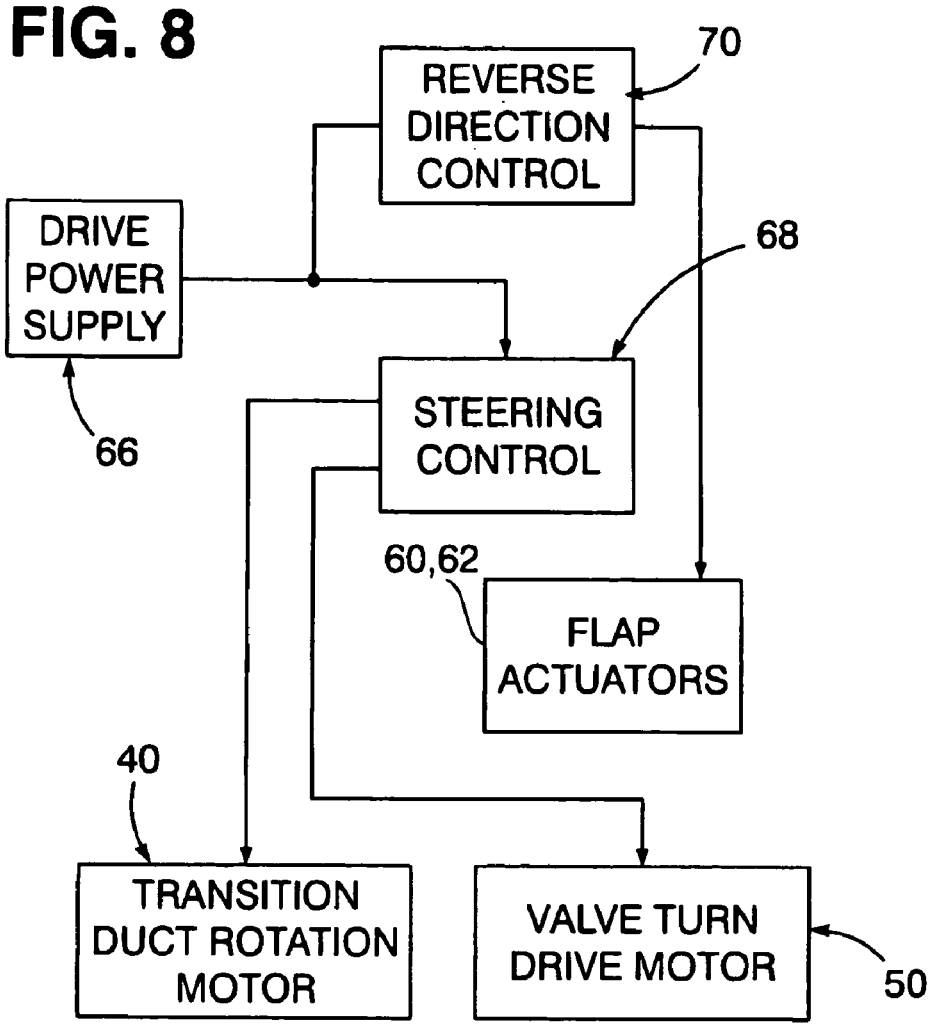
FIG. 8 is a schematic block diagram of the steering and reversing control system associated with the arrangement illustrated in FIGS. 1–7.

FIG. 8 diagrams the steering and directional reversing process as hereinbefore described, involving operation of the transition duct rotation motor 40, the exit jet flow vane motor 50 and the flap actuators 60 and 62. Thus a drive power supply 66 provides electrical energy through a steering control 68 to the motors 40 and 50 to effect steering maneuver by angular rotation of the exhaust duct 28 and pivotal displacement of the vanes 46. Reversal backing exit flow on the other hand is effected through a direction control 70 applied to the flap actuators 60 and 62.

Obviously, other modifications and variations of the present invention may be possible in light of the foregoing teachings. It is therefore to be understood that within the scope of the appended claims the invention may be practiced otherwise than as specifically described.

What is claimed is:

1. In combination with a jet propulsion body from which propulsion jet flow emerges, directional maneuvering means comprising: a transition duct through which the emerging propulsion jet flow is conducted; mounting means for connecting the transition duct to the propulsion body in angularly adjusted positions thereof; an exhaust duct attached to the transition duct through which exiting of the propulsion jet flow therefrom is effected; vane means pivotally mounted on the exhaust duct for angular adjustment of said exiting of the propulsion jet flow relative to the body while imparting forward thrust thereto; and flap means movably mounted on the exhaust duct for selectively blocking said exiting of the propulsion jet flow exiting directly therefrom while backwardly redirecting the propulsion jet flow from the exhaust duct to impart reverse thrust to the body in said angularly adjusted positions thereof.

2. The combination as defined in claim 1, including powered control means positioned within the body and operationally connected to the transition duct mounting means, the vane means and the flap means for directional steering and reversal of movement of the body in response to said emerging propulsion jet flow.

3. The combination as defined in claim 2, wherein the transition duct and the exhaust duct are formed with a cross-sectionally rectangular flow passage in alignment with a cross-sectionally circular flow passage in the body from which the propulsion jet flow emerges.

4. The combination as defined in claim 1, wherein the transition duct and the exhaust duct are formed with a cross-sectionally rectangular flow passage in alignment with a cross-sectionally circular flow passage in the body from which the propulsion jet flow emerges.

5. In combination with a jet propulsion body from which propulsion jet flow axially emerges, directional maneuvering means comprising: a transition duct through which the emerging propulsion jet flow is conducted; an exhaust duct attached to the transition duct through which exiting of the propulsion jet flow therefrom is effected; vane means pivotally mounted on the exhaust duct for angular adjustment of said exiting of the propulsion jet flow from the exhaust duct while forward thrust is being thereby imparted to the body; flap means movably mounted on the exhaust duct for selectively blocking said exiting of the propulsion jet flow therefrom while backwardly redirecting the propulsion jet flow from the transition duct to directly exit from the exhaust duct; and powered control means within the body operationally connected to the transition duct, the vane means and the flap means for directional steering and reversal of movement of the body in response to said emerging propulsion jet flow.

6. The combination as defined in claim 5, wherein the transition duct and the exhaust duct are formed with a cross-sectionally rectangular flow passage in alignment with a cross-sectionally circular flow passage in the body from which the propulsion jet flow emerges.

7. The combination as defined in claim 5, wherein said powered control means includes: electric motor means for angularly adjusted positioning of the transition duct relative to body while reverse thrust is being imparted thereto by said direct exit from the exhaust duct attached to the transition duct.

* * * * *